United States Patent [19]

Rennex

[11] Patent Number: 4,936,030

[45] Date of Patent: Jun. 26, 1990

[54] ENERGY EFFICIENT RUNNING SHOE

[76] Inventor: Brian G. Rennex, 2332 Antiqua Ct., Reston, Va. 22091

[21] Appl. No.: 269,750

[22] Filed: Nov. 8, 1988

Related U.S. Application Data

[63] Continuation-in-part of Ser. No. 65,595, Jun. 23, 1987, abandoned.

[51] Int. Cl.[5] ..... A43B 13/18; A43B 7/32

[52] U.S. Cl. ..... 36/28; 36/29; 36/102

[58] Field of Search ..... 36/27, 28, 29, 35 R, 36/35 B, 38, 102, 129

[56] References Cited

U.S. PATENT DOCUMENTS

| | | |
|---|---|---|
| 3,044,190 | 7/1962 | Urbany . |
| 3,914,881 | 10/1975 | Sartegel . |
| 4,030,213 | 6/1987 | Daswick . |
| 4,183,156 | 1/1980 | Rudy . |
| 4,217,705 | 8/1980 | Donzis . |
| 4,237,625 | 12/1980 | Cole . |
| 4,322,893 | 4/1982 | Halborsen . |
| 4,342,158 | 8/1982 | McMahon et al. . |
| 4,358,902 | 11/1982 | Cole . |
| 4,420,893 | 12/1983 | Stephan . |
| 4,446,346 | 5/1984 | Johnson . |
| 4,451,994 | 6/1984 | Fowler . |
| 4,486,964 | 12/1984 | Rudy . |
| 4,546,555 | 10/1985 | Spademan . |
| 4,635,384 | 1/1987 | Huh et al. . |
| 4,660,299 | 4/1987 | Omilusik . |
| 4,680,876 | 7/1987 | Peng . |
| 4,763,426 | 8/1988 | Polus et al. . |

FOREIGN PATENT DOCUMENTS 2183446 11/1986 United Kingdom .

OTHER PUBLICATIONS

"Groucho Running," *J. Applied Physiology* 23–26 (Jun. 1987), by T. McMahon and P. Greene.

"Running Shoes Waste Natural Energy of Feet," *N.Y. Times,* Sect. C, p. 2 (Jun. 2, 1987) by J. Gleick.

"Mechanics of Locomotion," 3*Int. J. of Robotics Research* 4 (1984), by T. A. McMahon.

*Primary Examiner*—Donald Watkins

*Attorney, Agent, or Firm*—Lowe, Price, LeBlanc, Becker & Shur

[57] ABSTRACT

This invention relates to a shoe having a mechanism in its sole to transmit the mechanical energy of heel impact to the front of the foot, where it is stored and then released during thrust. The mechanical energy of the impact on the rest of the foot (in front of the heel) is also stored and then released during thrust. The shoe is energy-efficient in that it returns as much of the energy of impact as possible to the runner during thrust. This means that the leg and foot muscles do not have to do as much work to lift the body weight against gravity. In addition to this resiliency feature, there is a compliance feature which reduces the impact shock on the runner's skeleton, muscles, and tendons. This compliance is achieved because the foot impact force is transmitted to the upper skeleton through a spring, which softens the shock transmitted to this upper skeleton.

43 Claims, 10 Drawing Sheets

FIG. 4
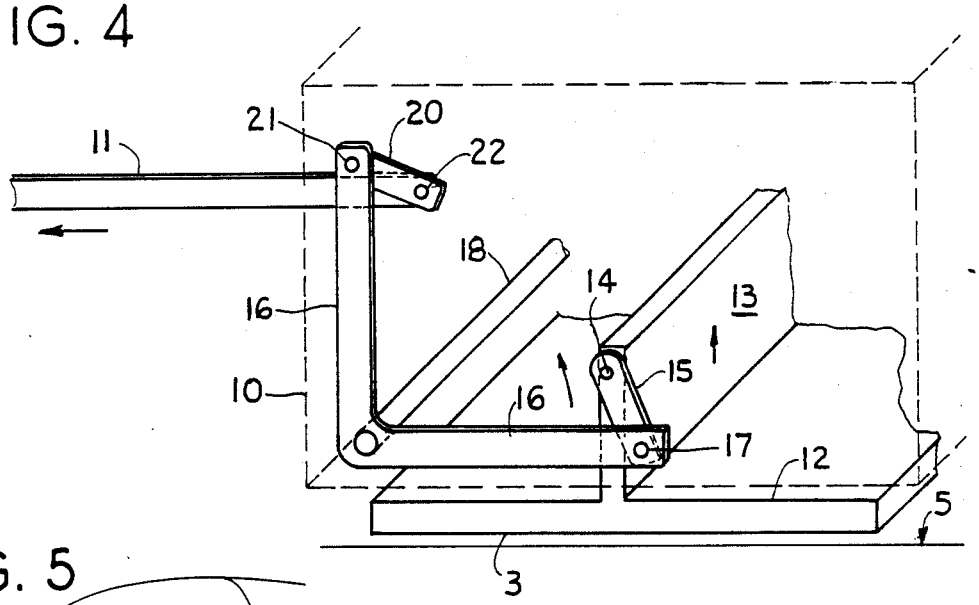
FIG. 5
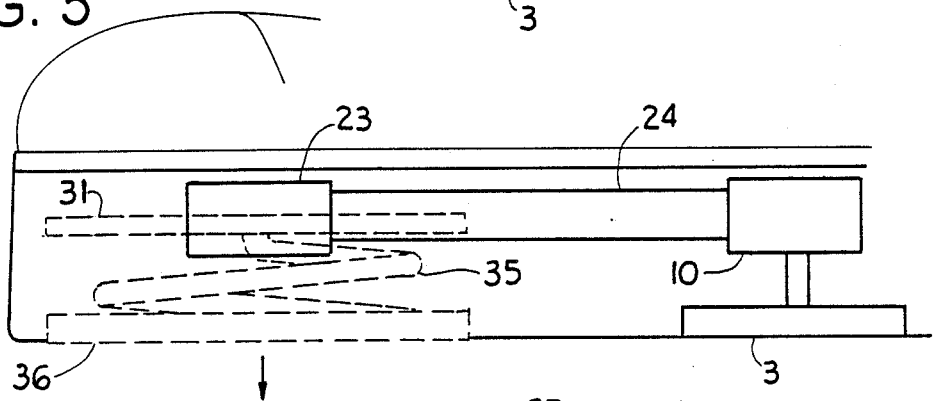
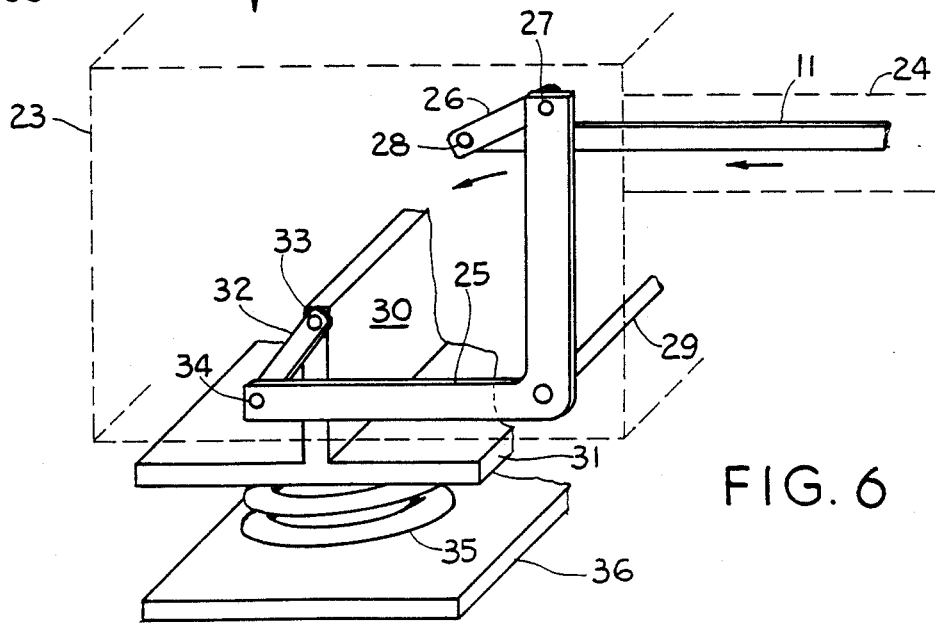
FIG. 6

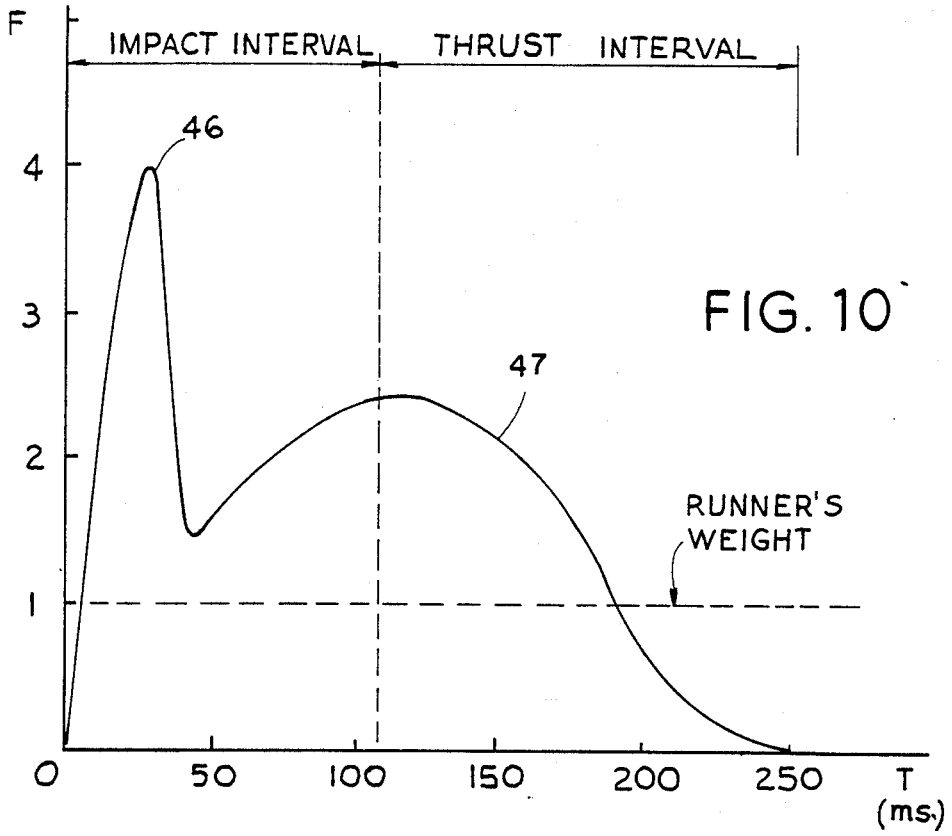
FIG. 10
FIG. 11
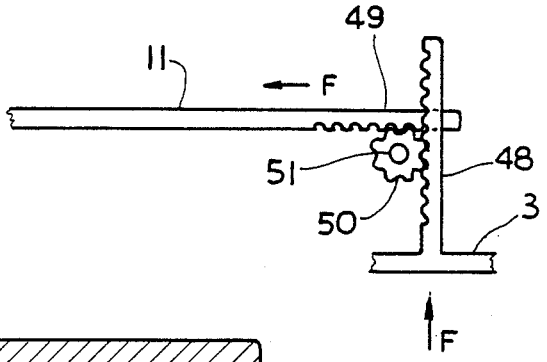
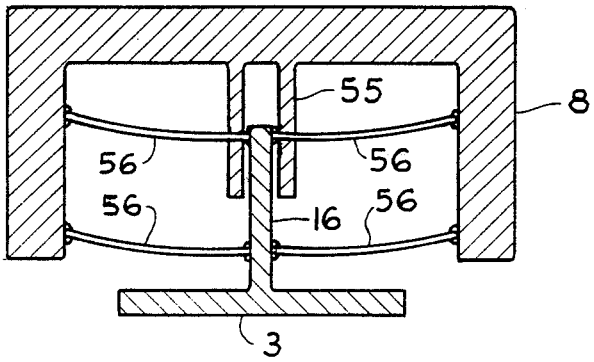
FIG. 12

FIG. 13
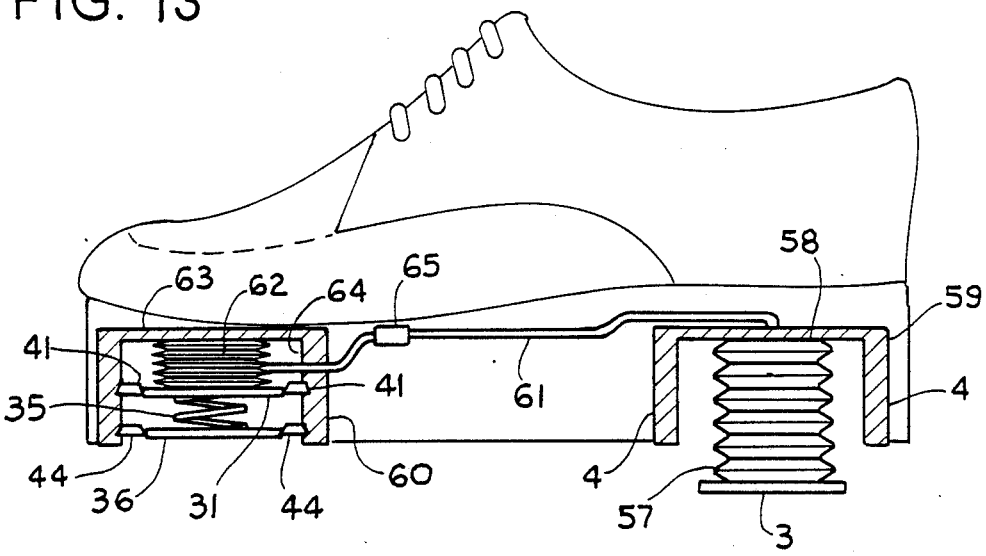
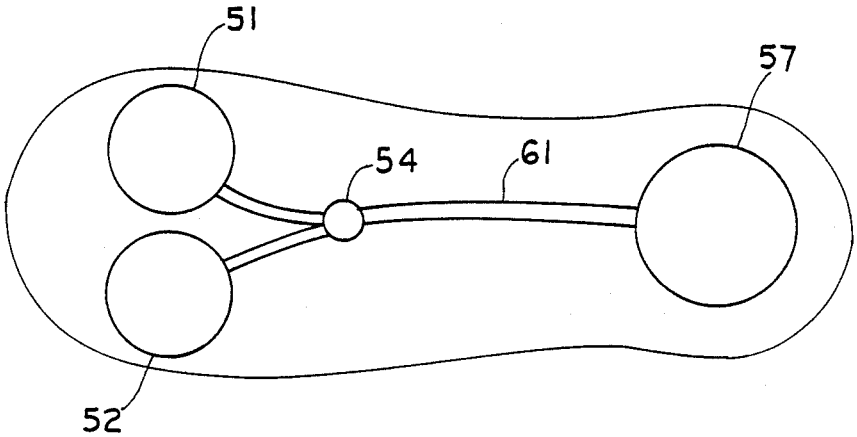
FIG. 14

FIG. 21
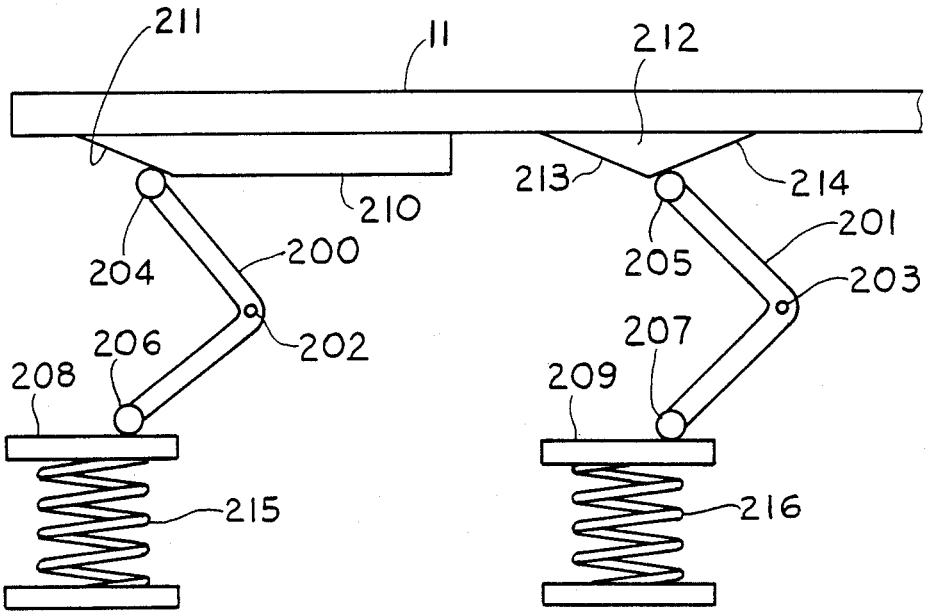
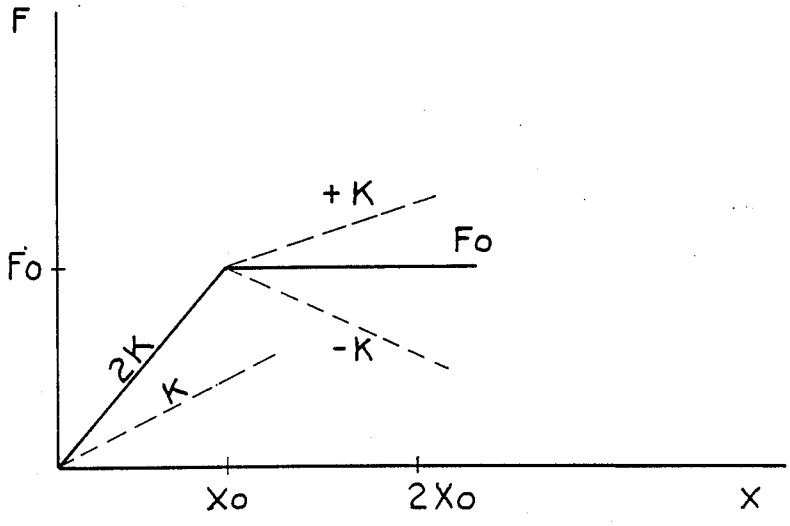
FIG. 22

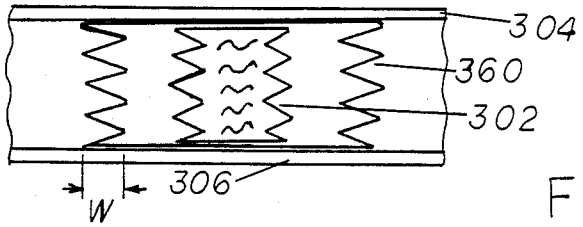
FIG. 24
FIG. 25
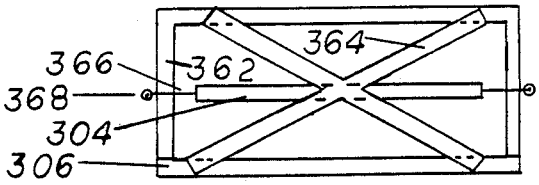
FIG. 26
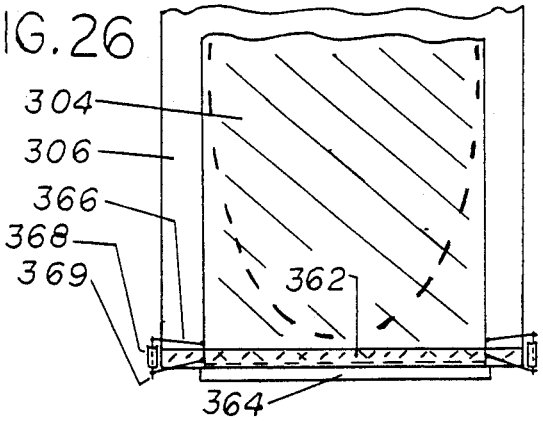
FIG. 27
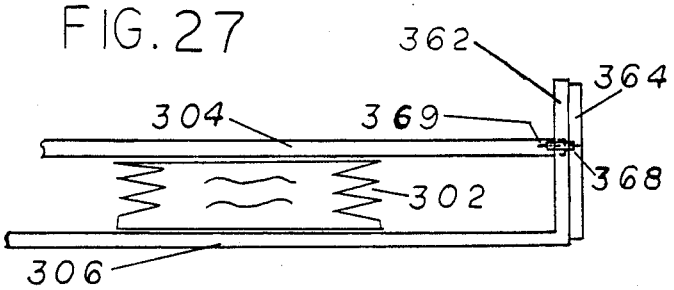

ENERGY EFFICIENT RUNNING SHOE

BACKGROUND OF THE INVENTION

This is a continuation-in-part of Application Ser. No. 065,595, now abandoned, filed 6-23-87. This invention relates to running shoes and in particular to energy-efficient running shoes.

The act of running involves vertical motion of a runner's center of gravity. The lifting of the runner's weight requires muscle work. When the runner's foot impacts the ground, the kinetic energy and the momentum associated with the vertical motion must be absorbed. Some of the vertical kinetic energy is stored in the resilient parts of the leg and foot, but most of it is lost to the ground and the leg. The lost energy must be replaced by muscle work. This invention is intended to minimize lost energy or, equivalently, to maximize the energy efficiency of running.

Scientific inquiry of running includes the study of the efficiency of running as a function of various parameters. Researchers have been attempting to apply their results to the optimization of running parameters to achieve greater energy efficiency and to reduce injuries. Dr. Thomas A. McMahon of Harvard University discussed how the resiliency of tracks can be tuned to improve performance and safety in his article "Mechanics of Locomotion," T. McMahon, 3 *Int. J. of Robotics Research* 4 (1984). One of his results is that running times improve by two or three percent and injuries are reduced by a factor of two when the effective spring constant of the track is approximately two times that of a runner's leg. Running shoes cannot improve energy efficiency equivalent to that achieved with tuned tracks, however, because impact is on the heel whereas take-off is from the toe.

Even if all of the impact energy is efficiently returned to the runner in toe thrust, the improvement in running times is expected to be only two or three percent. The reason is that the shoe acts in series with the runner's leg. Also, for effective running, the runner's knee must bend almost the same amount regardless of the spring in the shoes. Consequently, the runner's leg must work to support almost the same force for almost the same time, even though the shoe is providing some springboard action. The small benefit of a few percent results from the fact that the springboard action enables the runner to bound slightly higher, while bending the knee slightly less, for an equivalent amount of muscle work. Prior art running shoes capture roughly half of the impact energy (that due to front sole impact) and would be expected to improve running times by roughly one percent. My invention captures the other half and improves running times by yet another one percent.

Two concepts important in understanding the manner in which running shoes operate are compliance and resilience. Compliance refers to the property of the sole to give or compress upon foot impact; resilience refers to the property of the sole to return to its original shape. This can be made clearer by referring to a spring model with damping. The term damping includes all friction losses. A spring system may be very compliant by virtue of having considerable damping, but not energy efficient. Prior art running shoes have this drawback. The term resilience as used herein means that damping is minimized, so energy efficiency is maximized. In summary, compliance describes a system where impact energy is lost as well as conserved, whereas resilience refers to a system where energy loss is minimized.

An example of an invention that provides compliance in a shoe is described in U.S. Pat. No. 4,446,634. This shoe has liquid-filled bladders under the heel and sole, and controls the heel compliance with an adjustable valve in between. Since provision is made for energy storage and release, however, this shoe would not be energy efficient.

U.S. Pat. Nos. 4,237,625 and 4,358,902 disclose energy-efficient shoes. These have liquid-filled bladders below the heel and ball of the foot and resilient material below these bladders. However, there is no provision to transmit the energy of heel impact to the front of the foot, to store it, and to release it during thrust. The only energy that might be returned during thrust is that stored in the resilient material below the front of the foot, and this would be a small portion of the impact energy. Accordingly, this shoe would not be very energy-efficient.

U.S. Pat. No. 4,451,994 discloses a shoe having a resilient mid-sole. This shoe cannot capture the heel-impact energy, nor can it give back much of the "mid-sole-impact" energy during thrust. U.S. Pat. No. 4,030,213 discloses a shoe with springs throughout the sole. This shoe may be compliant, but it would not be energy efficient, since there is no provision for transferring heel impact energy to the front of the shoe.

Other references discovered by applicant during a prior art search are the following: U.S. Pat. Nos. 3,914,881; 4,217,705; 4,420,893; 4,546,555; 4,183,156; 4,486,964; 4,763,426; 4,635,384 and 4,342,158. Although compliant shoes are disclosed in these patents, none are energy-efficient.

SUMMARY OF THE INVENTION

Accordingly, one subject of the present invention is to provide a running shoe with improved performance that will make running more enjoyable and satisfying.

Another object of the present invention is to provide a running shoe that will reduce injuries.

A further object of the present invention is to provide a running shoe that will provide a high level of energy efficiency and adequate compliance on existing non-compliant surfaces, such as concrete.

A still further object of the present invention is to provide a shoe that will make walking less tiring and more comfortable by reducing the shock on the foot and other body parts.

Another still further object of the present invention is to provide a running shoe that has the ability to dramatically reduce impact shocks on the foot and body to compensate for weakened body parts, without a loss of running speed or energy efficiency.

Another object of the present invention is to provide a running shoe that corrects for pronation problems.

Yet another object of the present invention is to improve running times over prior art running shoes.

Other objects of the present invention will be apparent to those skilled in the art from the specification and drawings.

Briefly, in accordance with one embodiment of this invention, the foregoing objectives are achieved by providing a running shoe with a sole structure that transmits the force and energy of heel impact produced by vertical kinetic energy to the front of the shoe where it is stored. At the proper time this energy is released to contribute to the thrust off of the running surface at the front of the shoe.

The structure of this embodiment is comprised of two mechanisms. The first, referred to hereinafter as the "transmission mechanism," transmits the heel impact force to the front of the foot; the second, referred to hereinafter as the "storage/thrust mechanism," stores the energy associated with this force and then releases it during thrust. The transmission mechanism is mechanically coupled to the storage/thrust mechanism so that when the runner's heel impacts the running surface, the resulting impact energy is transmitted to the front of the foot where it is briefly stored and then released from the front of the foot during takeoff.

In another embodiment the foregoing objectives are achieved by providing means in the heel of the shoe which transmits the energy of heel impact produced by vertical kinetic energy, means for storing this energy and separate means in the front of the shoe for releasing this energy to contribute to thrust off of the running surface.

BRIEF DESCRIPTION OF THE DRAWINGS

FIG. 4 is a perspective view of the force-redirection mechanism used in the first embodiment of this invention.

FIG. 5 is a side view of the first embodiment of this invention, showing the transmission mechanism and the storage/thrust mechanism.

FIG. 6 is a perspective view of the storage/thrust mechanism used in the first embodiment of this invention.

FIG. 10 is a "force versus time" curve for a runner's foot impact and thrust.

FIG. 11 is a side view of the heel portion of a variation of the first embodiment of this invention using a double rack and pinion transmission mechanism.

FIG. 12 is an end view of an anti-tilt mechanism for the heel force plate of this invention.

FIG. 13 is a side view of a second embodiment of this invention, showing the transmission mechanism and the storage/thrust mechanism using Sylphon bellows.

FIG. 14 is a bottom view of the running shoe of this invention, showing two storage/thrust mechanisms.

FIG. 21 is a side view of the toe portion of a variation of the fourth embodiment of this invention in which two storage springs are compressed so as to achieve a combined constant "force versus time" curve.

FIG. 22 is a "force versus time" curve for the variation of the fourth embodiment of this invention illustrated in FIG. 21.

FIG. 24 is a side view of an auxiliary heel stabilizer employing stabilizer bellows for the fifth embodiment of this invention.

FIG. 25 is an end view of an auxiliary heel stabilizer employing a stabilizer cable and a stabilizer roller for the fifth embodiment of this invention.

FIG. 26 is a top view of the auxiliary heel stabilizer employing a stabilizer cable and stabilizer roller for the fifth embodiment of this invention.

FIG. 27 is a side view of the auxiliary heel stabilizer shown in FIGS. 25 and 26.

DETAILED DESCRIPTION OF THE PREFERRED EMBODIMENTS

Figure 1:
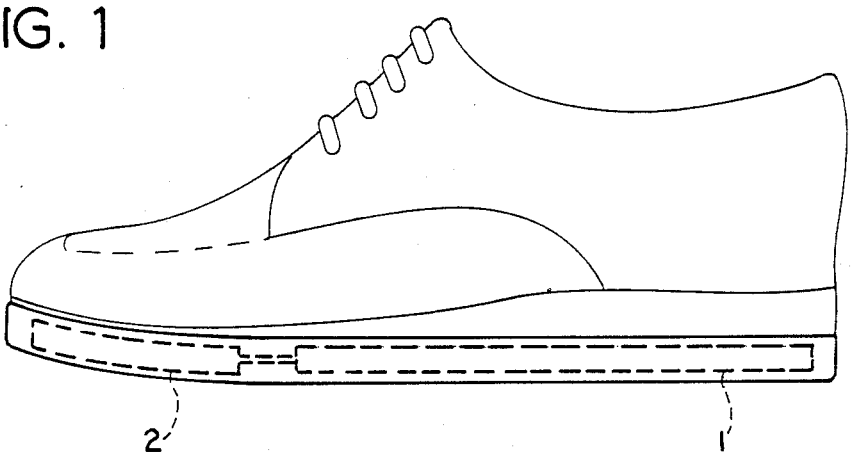
FIG. 1 is a schematic side view of the running shoe according to this invention, showing the location in the sole of the transmission mechanism and the storage/-thrust mechanism.

Referring now to the drawings wherein like referenced numbers designate identical or corresponding parts throughout the several views, FIG. 1 is a schematic representation of the location of transmission mechanism 1, which re-directs the runner's heel impact force and transmits it to the front of the sole, and storage/thrust mechanism 2, which stores the energy of the heel impact force below the front of the foot and releases it to contribute to the thrust which propels the runner back into the air.

Figure 2:
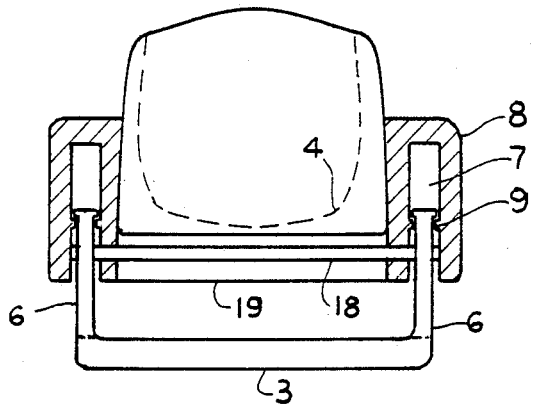
FIG. 2 is an end view of the heel portion of the first embodiment of this invention, showing the transmission mechanism.

Referring now to FIG. 2, heel force plate 3, which is positioned under the runner's heel 4, receives the force of heel impact on running surface 5. Heel force plate 3 has four vertical guide bars 6, arranged in a quadrilateral configuration about heel 4, which move perpendicular to the running surface in channels 7 in anti-tilt housing 8. This ensures that heel force plate 3 does not tilt or bind, even when the impact force of the ground is not centered on it. Stops 9 on guide bars 6 prevent the guide bars from exiting channels 7.

Figure 3:
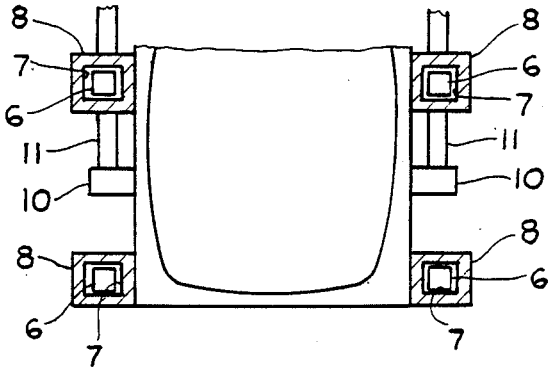
FIG. 3 is a top view of the heel portion of the first embodiment of this invention.

FIG. 3 more clearly illustrates anti-tilt housing 8, and guide bars 6 and channels 7 contained therein. As further shown in this figure, force re-direction mechanism 10, which is driven by the upward motion of heel force plate 3, causes drive shafts 11, positioned at opposite sides of the sole, to move forward toward the toe of the running shoe, thereby transmitting the heel impact force to the front of the sole.

One end of force re-direction mechanism 10 is shown in greater detail in FIG. 4. It should be noted that the other end of this mechanism has the same component parts and operates in the same manner as described hereinafter. Heel force plate 3 comprises horizontal plate 12, whose bottom is covered with a conventional running shoe material such as Vibram, and raised plate 13 aligned perpendicular to plate 12. Pin 14 is attached to the top portion of raised plate 13 and extends slightly beyond the side edge thereof. Hinged link 15, located along side the end of vertical plate 12, is rotatably fastened to pin 14. The other end of hinged link 15 is rotatably fastened at the end of one arm of conventional bent lever 16 by pin 17. Bent lever 16 is rotatably fastened to an axle 18 at the junction point of its two arms.

Referring again to FIG. 2, axle 18 passes through and is embedded in sole 19 of the running shoe, so that it does not move relative to sole 19. The upper arm of bent lever 16 is rotatably fastened to a second hinged link 20 by pin 21. The other end of hinged link 20 is rotatably fastened to drive shaft 11 by pin 22.

When heel force plate 3 strikes running surface 5, the impact force causes it to move upward toward heel 4 and sole 19. Since axle 18 is not free to move relative to sole 19, the upward movement of heel force plate 3 causes hinged link 15 to move upward and bent lever 16 to rotate in an arc in a counterclockwise direction. It should be understood that the corresponding bent lever on the opposite end of heel force plate 3 will rotate in the same direction as bent lever 16. Raised plate 13 is used because hinged link 15 must pull rather than push. The counterclockwise rotation of bent lever 16 pulls hinged link 20 towards the toe of the shoe, thereby forcing drive shaft 11 to travel in the same direction. Hence, it will be seen that hinged link 20 converts the circular arc motion of bent lever 16 to the straight-line motion of drive shaft 11. It should also be noted that the two legs of bent lever 16 may be of different lengths in order to provide mechanical advantage to force-redirection mechanism 10.

Referring now to FIG. 5, drive shaft 11 is coupled at its front end to another force re-direction mechanism 23. Drive shaft 11 is contained in a shaft housing 24, which constrains it to travel forward and rearward in a straight line. It should be understood that an identical drive shaft and shaft housing are located on the opposite side of the shoe.

Referring now to FIG. 6, drive shaft 11 is connected to bent lever 25 by conventional hinged link 26. Hinged link 26 is rotatably fastened to the upper arm of bent lever 25 by pin 27, and rotatably fastened to drive shaft 10 by pin 28. An axle 29 passes through bent lever 25 at the junction of its two arms and is rigidly mounted in the forward portion of sole 19 so that bent lever 25 can rotate around it. The lower arm of bent lever 25 is connected to raised plate 30 of storage plate 31 by hinged link 32. Hinged link 32 is rotatably connected to raised plate 30 by pin 33 and rotatably connected to the lower arm of lever 25 by pin 34. Storage plate 31 is rigidly connected to one end of helical storage spring 35. The other end of storage spring 35 is rigidly attached to thrust force plate 36, which contacts running surface 5 and, like heel force plate 3, has its bottom covered with a conventional running shoe sole material such as Vibram. Alternatively, multiple springs, resilient plastic, or an elastomer can replace storage spring 35, thereby providing an advantage in durability or weight. When drive shaft 11 is driven forward by force re-direction mechanism 10, bent lever 25 rotates in a counterclockwise direction around axle 29, moving storage force plate 31 downward and compressing storage spring 35.

Ideally, storage spring 35 obeys a force law $F=kx^y$, where y is less than 1.0 and held as small as possible, k is the spring constant of storage spring 35, and x is the distance travelled by spring 35 from its uncompressed position to its compressed position. Alternatively, storage spring 35 may be pre-compressed in which case $F=F_o+K$, where $F_o$ is the pre-compression force.

Figure 7:
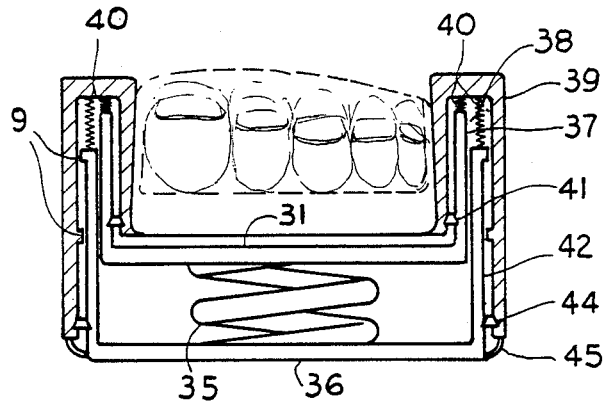
FIG. 7 is a front view of the toe portion of the first embodiment of this invention, showing the storage/-thrust mechanism.
Figure 8:
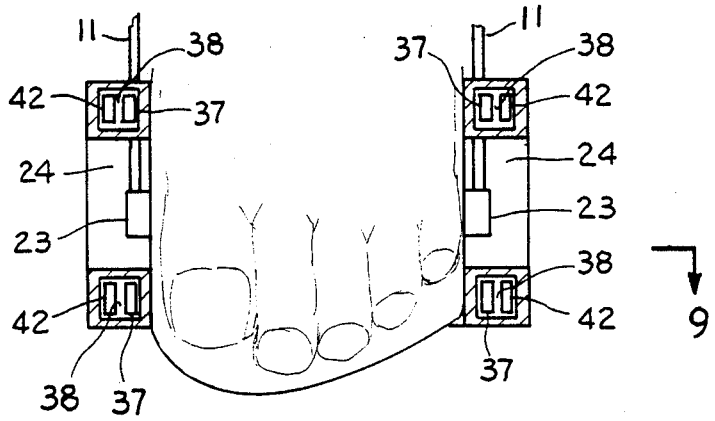
FIG. 8 is a top view of the toe portion of the first embodiment of this invention, showing the storage/-thrust mechanism.

Referring now to FIGS. 7 and 8, storage force plate 31 is fixably attached to four guide bars 37 arranged in a quadrilateral pattern around the toe portion of the running shoe. Guide bars 37 move perpendicular to storage force plate 31 in channels 38 contained in anti-tilt housing 39. The top portion of each guide bar 37 is connected by a spring 40 to said housing at the top of its corresponding channel 38. Springs 40 have minimal resistance and thus require a minimum amount of energy to stretch. A conventional ratchet device 41 is attached between housing 40 and guide bar 37, allowing storage force plate 31 to move downward but not upward. This ensures that the impact energy stored in spring 35 is not lost by the upward movement of force plate 31. It will be seen that such upward movement would move drive shafts 11 rearward, resulting in the re-transmission of the impact energy back to heel 4.

Compression of storage spring 35 by storage force plate 31 continues for the duration of the heel impact interval. Storage spring 35 is also compressed from the bottom by thrust force plate 36 during the period of toe impact. Thrust force plate 36 has four guide bars 42, each of which shares a channel 38 with a guide bar 37 from thrust force plate 31. Alternatively, anti-tilt housing 39 has separate channels for guide bars 37 and 42. Four conventional ratchet devices 44, each of which is mounted to the exterior wall of one of channels 38, prevent thrust force plate 36 from moving downward against the running surface until released, as described with reference to FIG. 9 below. This ensures that any toe impact energy is stored until thrust. Ratchets 44 are released at the beginning of the thrust interval, allowing storage spring 35 to expand to its uncompressed state and causing thrust force plate 36 to push against the running surface, thereby aiding the runner's propulsion into the air.

Figure 9:
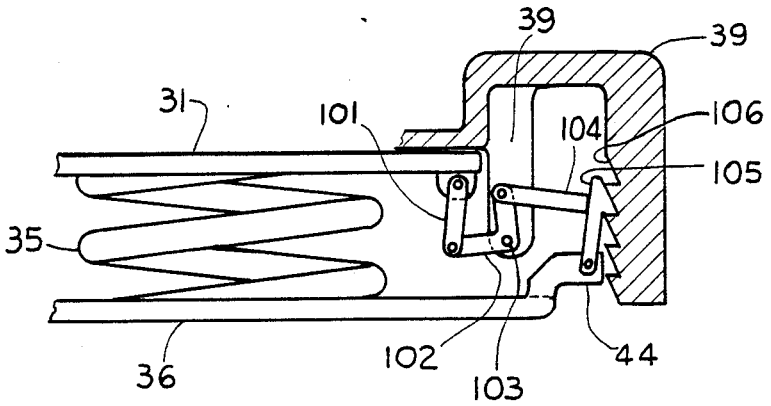
FIG. 9 is a side view of the ratchet release mechanism used in the first embodiment of this invention.

Ratchet mechanism 44 is shown in FIG. 9. Ratchet release is determined by the relative spacing between storage force plate 31 and anti-tilt housing 39. Hinged link 101 is rotatably mounted at one end to the bottom of storage force plate 31 and rotatably mounted at the other end to the bottom arm of bent lever 102. Bent lever 102 is rotatably mounted at the junction of its two arms to axle 103, which is fixably attached to anti-tilt housing 39. The upper arm of bent lever 102 is rotatably mounted to one end of hinged link 104, and the other end of hinged link 104 is rotatably mounted to conventional ratchet arm 105. This latter attachment point is vertically lower than the former attachment point and remains so throughout the range of movement of hinged link 104. The other end of ratchet arm 105 is rotatably mounted to thrust force plate 36. Ratchet teeth 106 are formed at the bottom portion of anti-tilt housing 39 so that ratchet arm 105 can engage each tooth as it moves upward.

As storage spring 35 is compressed and force plates 31 and 35 move toward each other, hinged link 101 moves downward relative to axle 103, causing bent lever 102 to rotate counter-clockwise. This rotation causes hinged link 104 to move toward storage spring 35, thereby pulling ratchet arm 105 away from teeth 106. When force plates 31 and 36 are sufficiently close, ratchet arm 105 disengages from ratchet teeth 106, allowing storage spring 35 to expand to its uncompressed state and causing storage force plate 36 to move downward. Ratchet arm 105 remains disengaged until, after thrust, the action of recovery springs 40 of FIG. 7 cause storage force plate 31 and thrust force plate 36 to return to their pre-impact positions with respect to anti-tilt housing 39. For recovery springs 40 to have effect, ratchets 41 must be released, allowing storage force plate 31 to move upward. This is accomplished with a ratchet release mechanism similar to that shown in FIG. 9, except that the release is keyed to the relative motion of storage force plate 31 and thrust force plate 36. Accordingly, release occurs when thrust force plate 36 expands to its original position with respect to storage force plate 31. This release, in turn, causes bent lever 25 (shown in FIG. 6) to return to its original position, which in turn moves bent lever 16 (shown in FIG. 4) to its original position and heel force plate 3 to its original position in preparation for the next heel impact.

Alternatively a conventional electronic device may be used to measure the relative velocity between storage force plate 31 and thrust force plate 36. When the velocity becomes zero, this devices releases ratchet 44. As another alternative, release could occur after a fixed time delay. Although this method possibly provides more optimized timing of the release, it has the disadvantage of requiring battery power.

It should be understood that the entire force re-direction mechanism of FIGS. 4 and 5 could be incorporated into the sole of the shoe, with the accompanying restriction that the sole must be thicker and/or the allowed travel of the force-plates smaller.

FIG. 10 is a plot of the force exerted by a runner's foot on the ground (vertical axis) versus time (horizontal axis) from "Groucho Running," by T. McMahon, et al., 62 *J. Applied Physiology*, 23–26 (June 1987). The time interval during which the foot (through the shoe) is in contact with the ground is referred to as the foot-contact interval. The portion of the foot-contact interval in which the heel is striking the running surface is referred to as the "impact interval" and the portion of this interval in which the toe is lifting off of the running surface is referred to as the "thrust interval." At initial heel impact there is a force spike 46 resulting from the fact that the runner's leg is very stiff, since it is almost straight when the runner's heel first impacts the running surface. The remaining portion of the impact interval is represented by the upwardly sloping portion of peak 47, during which time the force of the runner's foot on the ground is increasing, while the thrust interval is represented by the downwardly sloping portion of peak 47, during which time the force is decreasing. Transmission mechanism and the storage portion of storage/thrust mechanism 2 of the present invention operate during the impact interval, and the thrust portion of storage/-thrust mechanism 2 operates during the thrust interval.

A brief discussion of the mechanics of running shows how the invention is energy efficient and compliant. As explained above, spike 46 near the beginning of the impact interval occurs because the straight leg is very stiff. If the model of a mass (the runner's weight) on a spring (the runner's legs) is used, then the effective spring constant is high, corresponding to a stiff leg. The impact interval is inversely proportional to the square root of the spring constant, and the area under the curve during the impact interval must equal the runner's original vertical momentum. Since the impact interval decreases with greater values of spring constant, the height of force spike 46 must increase to maintain the same momentum area.

This force spike can be as large as 5 times the runner's weight. It is transmitted up the leg and spine, damaging joints, ligaments, and tendons. It can be reduced by making the ground more compliant, or, as in this invention, by putting a compliant mechanism in the shoe. Either case can be modeled with a mass (the runner's weight) on two springs in series (representing the runner's leg and either the compliant ground or a compliant shoe).

The two-spring model predicts the force on the ground, and this is an indication of the resulting shock on the skeleton. This force is equal to the force that would result from a one-spring model with a spring constant, k, defined by $1/k = 1/k_1 + 1/k_2$, where $k_1$ is the spring constant of the runner's leg and $k_2$ is the spring constant of the running or a compliant running surface. In effect, the leg spring constant $k_1$ is decreased by the second spring in series, to the value of the effective spring constant, thus reducing significantly the shock felt by the leg. With two springs, the force spike in FIG. 10 becomes an elbow on the left side of peak 47, shown by the dotted line.

A value for spring constant $k_2$ that is too large will not give optimal compliance and a value that is too small will give a foot-contact interval that is too long. Such a long interval would result in slow and inefficient running. In the previously mentioned article entitled *Mechanics of Locomotion*, McMahon presented evidence that the optimal value for spring constant $k_2$ is approximately twice that of spring constant $k_1$.

A second embodiment of force re-direction mechanism 10 is illustrated in FIG. 11. In this embodiment, bent lever 16 in FIG. 4 is replaced by a pair of racks 48 and 49 and a pinion 50. This arrangement allows a more variable amount of travel for heel force plate 3. Heel force plate 3 is rigidly attached to perpendicularly aligned rack 48. Pinion 50 is rotatably fastened to an axle 51, which passes through and is embedded in sole 19 of the running shoe so that it is not free to move relative to the sole. The upward movement of heel force plate 3 and rack 48 due to heel impact causes pinion 50 to rotate counterclockwise, driving rack 49 forward. Rack 49 is rigidly attached to drive shaft 11, causing it to move forward on heel impact. The same rack and pinion force re-direction mechanism may also be used in place of force re-direction mechanism 23 in FIG. 6. While this mechanism probably would weigh more than the bent lever mechanism of the first embodiment of the present invention, it would eliminate the need for hinged links 15 and 20 of FIG. 4 therein.

FIG. 12 illustrates a cut-away side view of an alternative embodiment of anti-tilt housing 8 and heel force plate 3 to prevent heel force plate 3 from tilting. Housing 8 has a U-shaped channel 55 which constrains movement of raised rod 16 to a direction perpendicular to the plane of heel force plate 3. Conventional corrugated flat springs 56 are attached between the inner portion of the outer wall of housing 8 and the outer walls of channel 55. Springs 56 move easily in a direction perpendicular to their axis but resist change along their length, thus preventing raised plate 13 and heel force plate 3 from tilting laterally relative to housing 8. Another set of four springs prevents tilting longitudinally. This embodiment produces very little friction.

FIG. 13 illustrates a second embodiment of the present invention using hydraulics to convert the heel impact energy to toe thrust energy. Conventional Sylphon bellows 57 is attached at one end to heel force plate 3 and at the other end to a wall 58 which is parallel to heel force plate 3 and which is located in heel housing 59. Bellows 57 is constrained to move perpendicular to the running surface by guide bars 7 (as shown in FIG. 3) attached to heel force plate 3. A tube 61 is attached at one end to the top of bellows 57 through a hole in wall 58 and at the other end to a second Sylphon bellows 62 in the toe portion of the sole. The top portion of Sylphon bellows 62 is attached to a wall 63 in housing 64, and the bottom portion of Sylphon bellows 62 is attached to storage force plate 31. As described above with respect to FIGS. 6 and 7, the bottom portion of storage force plate 31 is attached to the top end of storage spring 35 and the bottom end of storage spring 35 is attached to thrust force plate 36. Sylphon bellows 57 and 62 are filled with oil and change volume in the vertical direction only when compressed.

Upon heel impact, heel force plate 3 compresses bellows 57 against wall 58. This causes oil to flow through tube 61, which is just large enough to avoid significant viscous friction from oil flow due to the sudden impact. Oil emerging from the other end of tube 61 causes bellows 62 to expand, which in turn moves storage force plate 31 downward and compresses storage spring 35. Conventional catch mechanisms 41 and 44 operate in the same manner described above with respect to FIGS. 7 and 9 to allow thrust force plate 36 to move downward to aid take-off thrust and to prevent storage force plate 31 and thrust plate 36 from returning to their rest positions until after the shoe is in midair. A conventional one-way valve 65 prevents the oil, and hence the heel impact force, from returning to the heel after thrust. At that time a conventional release mechanism that is keyed to the return of thrust force plate 36 to its uncompressed position with respect to storage force plate 31 (as in FIG. 9), opens valve 65 and allows the oil in bellows 57 and 62 to return to their original pre-impact positions. It should be seen that it is still necessary to have an anti-tilt housing mechanism in this embodiment similar to that discussed in connection with the first embodiment of FIGS. 2–7.

The second embodiment illustrated in FIG. 13 has the advantage of eliminating certain moving parts, namely the bent levers and drive shafts. Also, considerable force can be accommodated hydraulically.

An alternative to metal Sylphon bellows would be bellows constructed of an elastomer, possibly in conjunction with metal hoops. This would reduce the weight of the bellows and improve durability. Alternatively, bladders in a housing or pistons could be used instead of bellows.

In yet another version of the hydraulic embodiment, several bellows may be distributed over heel force plate 3. This could reduce the total weight and the amount of bellows material while accommodating the impact forces. As another variation of the hydraulic embodiment, air can be used as the hydraulic material rather than oil. Although this would result in a lighter shoe, it would be less energy-efficient, since air compresses and therefore some impact energy would be lost.

In another alternative embodiment, conventional hollow spheres are used to fill part of the volume inside the Sylphon bellows in order to reduce the weight of the oil or other fluid in the bellows. The bellows have a minimum volume to which they can be compressed without damage and that minimum volume can be filled with hollow spheres. The hollow spheres have a diameter at least three times the diameter of the connective tubes between the bellows.

FIG. 14 illustrates a variation of the second embodiment of the present invention having multiple thrust/storage mechanisms. In this embodiment thrust storage mechanisms 51 and 52 are side-by-side in the front of the shoe and transmission mechanism 53 is in the heel of the shoe. The same hydraulic force re-direction mechanism of FIG. 13 would be used, except that tube 61 would be split into two branches at the front of the shoe by conventional hydraulic valve 54. Upon heel impact, a portion of the oil flowing from bellows 57 would go to the Sylphon bellows in thrust/storage mechanism 51 and the remaining portion would go to the Sylphon bellows in thrust/storage mechanism 52. This configuration allows for different proportions of impact force to be transmitted to each side of the front of the shoe. Pronation problems could be corrected by altering the relative amount of oil flowing to thrust/storage mechanisms 51 and 52.

Figure 15:
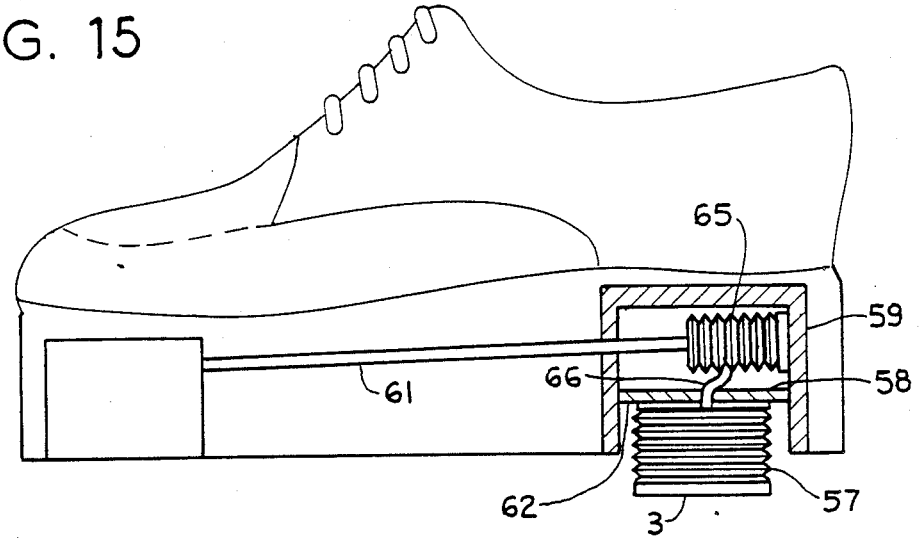
FIG. 15 is a side view of the heel portion of a third embodiment of this invention, using two Sylphon bellows in the transmission mechanism.

FIG. 15 illustrates a third embodiment of the present invention. In this embodiment Sylphon bellows 57 again are connected at one end to heel force plate 3 and at the other end to housing wall 58. A tube 66 is connected at one end to the top of bellows 57 through a hole in wall 58 and at the other end to a second Sylphon bellows 65. One end of bellows 65 is connected to drive shaft 11 and the other end is mounted against the interior side wall of housing 59.

Upon heel impact, heel force plate 3 moves upward, causing oil to flow through tube 66 into bellows 65. Bellows 65 expands, moving drive shaft 11 forward. At the front of the shoe, the horizontal movement of drive shaft 11 is changed to vertical movement, using either the same type of Sylphon bellows mechanism as illustrated in FIGS. 14 or 15 or some other device, such as the bent lever illustrated in FIG. 6. Energy stored in the toe portion of the shoe is prevented from returning to the heel either by a conventional valve between the two bellows in the front of the shoe (assuming the mechanism of FIG. 15 is employed) or by the ratchet release mechanism described above with respect to the first embodiment of FIGS. 2–8 (assuming a bent lever mechanism is used). In this way, the Sylphon bellows in the heel mechanism do not return to their original positions until after the runner is in mid-air. As an alternative embodiment, the bellows of FIG. 15 can be replaced with a chamber containing two pistons, one moving vertically and the other moving horizontally.

Figure 16:
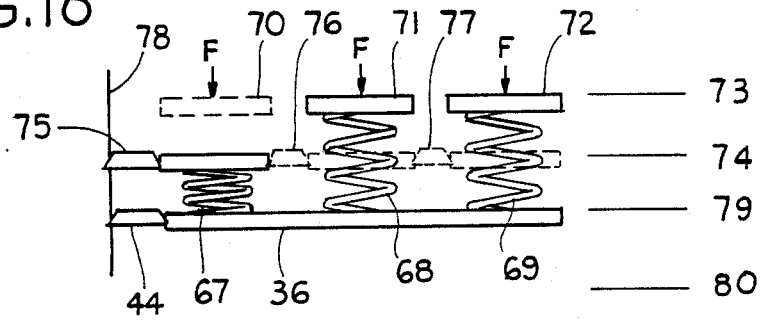
FIG. 16 is a side view of the toe portion of a fourth embodiment of this invention using sequential storage springs.

FIG. 16 illustrates schematically the fourth embodiment of the present invention. In this embodiment, storage spring 35 of FIGS. 5 and 6 is replaced by three storage springs 67, 68 and 69; and storage force plate 31 is replaced by three storage force plates 70, 71 and 72. This configuration limits the impact force of the foot on the running surface by switching from one storage spring to the next when the impact force reaches a prescribed value. Doing so limits the impact or shock felt by the skeleton to a particular value, e.g., 25 percent over the runner's body weight. Obviously, any number of storage springs could be used in this embodiment.

Figure 17:
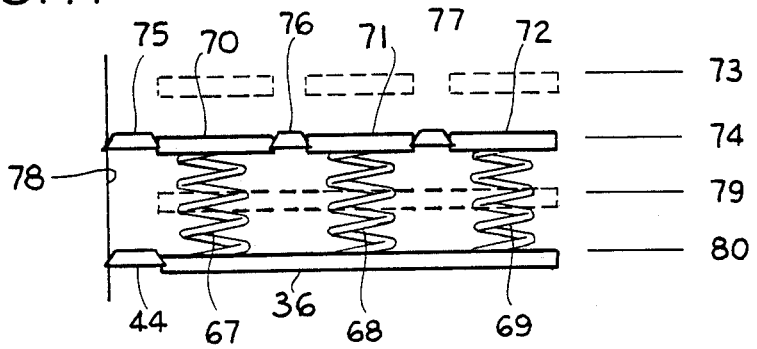
FIG. 17 is another side view of the toe portion of the fourth embodiment of this invention, showing the sequential compression of all storage springs.

This embodiment employs the bent lever force redirection mechanism of the first embodiment of the present invention illustrated in FIGS. 2–8. Upon heel impact, the first storage force plate 70 of FIG. 16 in the toe of the shoe is driven from position 73 to position 74 and the force on the first spring 67 increases to a maximum force corresponding to the first small peak 99 illustrated in the force-vs-time curve of FIG. 20. When storage force plate 70 reaches point 74, the driving force is switched to storage force plate 71, as described hereinafter. At that time, the force in FIG. 19 reduces to zero because the impact force is now acting against the second spring 68 which initially has zero travel. When storage force plate 71 has moved from position 73 to position 74 and storage spring 68 has been compressed to the same maximum force 99 as spring 67, the driving force is switched to the third storage force plate 72, as described hereinafter. It, in turn, compresses storage spring 69 until force plate 72 has reached position 74. Each of force plates 70, 71 and 72 is restrained from returning to position 73 by ratchet devices 75, 76 and 77, respectively, attached to housing 78 of the toe housing. FIG. 17 illustrates the situation where storage springs 67, 68 and 69 are fully depressed.

During the thrust interval, catch 44 is released in the same manner as described above with respect to FIGS. 7 and 9. Springs 67, 68 and 69 then simultaneously give a powerful downward thrust to thrust force plate 31, causing it to move from position 79 to position 80, which aids in propelling the runner's leg into the air.

Figure 18:
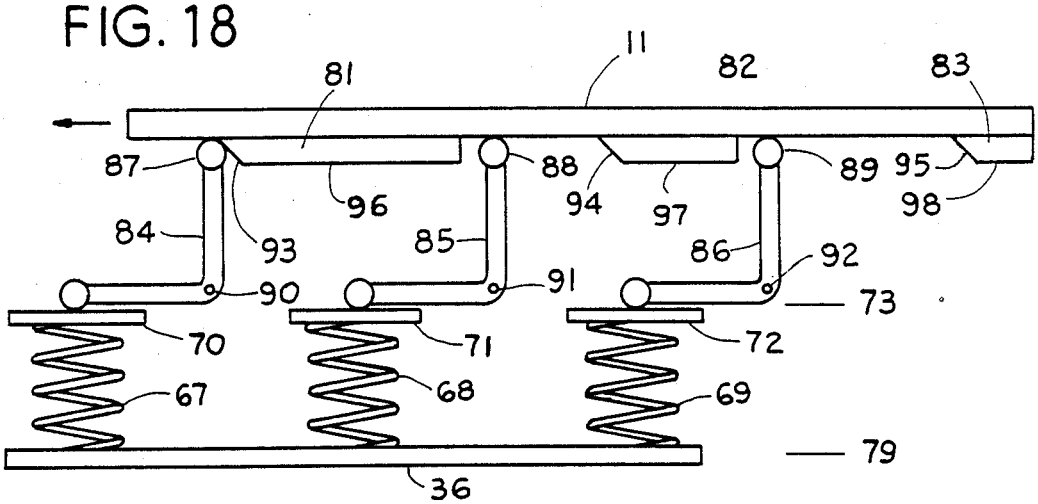
FIG. 18 is another side view of the toe portion of the fourth embodiment of this invention, showing the mechanism for sequentially compressing the storage springs.

The first of two examples of means for switching the impact drive force from one spring to the next is shown in FIG. 18. Bent levers 84, 85 and 86 are each connected to drive shaft 11 and rotate about axles 90, 91, and 92 in the same manner as illustrated in FIG. 6. Similarly, bent lever 84 is connected at one end to storage force plate 70, bent lever 85 is connected to storage force plate 71, and bent lever 86 is connected to storage force plate 72, in the same manner as illustrated in FIG. 6. Conventional roller bearings 87, 88 and 89 are rotatably attached to the other ends of bent levers 84, 85 and 86, respectively. Attached to the bottom side of drive shaft 11 are tabs 81, 82 and 83, each of which has an inclined ramp 93, 94 and 95, respectively. At the end of these ramps are flat surfaces 96, 97 and 98, respectively, positioned parallel to the bottom surface of drive shaft 11. In the rest position roller bearings 87, 88 and 89 are in contact with the bottom surface of drive shaft 11, with bearing 87 positioned immediately adjacent ramp 93, bearing 88 positioned forward of ramp 94 at a specified distance, described below, and bearing 89 positioned forward of ramp 95 at a greater distance, also described below.

Figure 19:
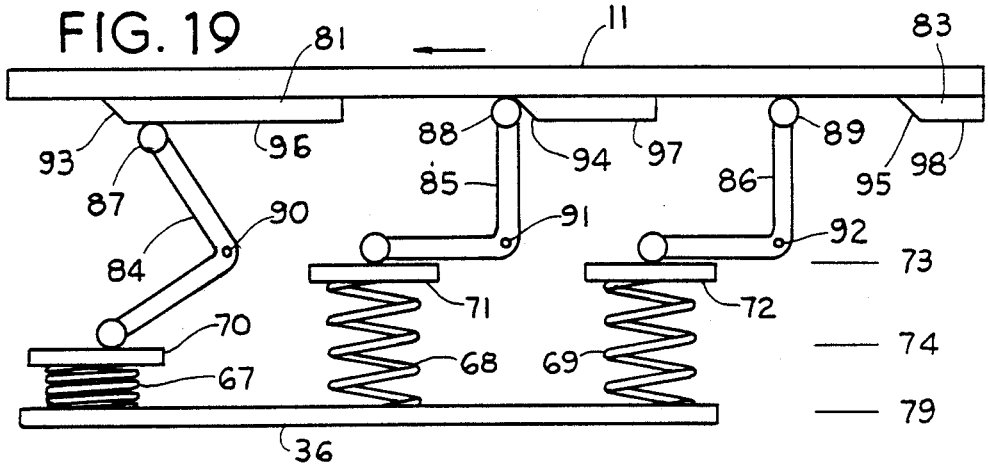
FIG. 19 is another side view of the toe portion of the fourth embodiment showing the position of the storage springs when the first spring is fully compressed.

The initial forward motion of drive shaft 11 causes roller bearing 87 to move up ramp 93, which rotates bent lever 84 counterclockwise around axle 90. This rotation compresses storage spring 67. When bearing 87 reaches flat position 96 of tab 81, storage force plate 70 arrives at position 74, and bearing 88 arrives at the beginning of ramp 94, as shown in FIG. 19. The positions of bent lever 84 and storage force plate 72 do not change as drive shaft 11 continues moving forward. However, this movement causes roller bearing 88 to move up ramp 94, thereby rotating bent lever 85 counterclockwise and depressing storage force plate 71 and storage spring 68.

When bearing 88 reaches flat portion 97 of tab 82, storage force plate 71 arrives at position 74 and bearing 89 arrives at the beginning of ramp 95. The positions of bent lever 85 and storage force plate 71 do not change as drive shaft 11 continues moving forward. Again, however, such movement causes roller bearing 89 to move up ramp 95, thereby rotating bent lever 86 counterclockwise and depressing storage force plate 72 and storage spring 69. As with the first embodiment of this invention, ratchets 44 are released at the beginning of the thrust interval, allowing thrust force plate 36 to move downward against the running surface and storage springs 67, 68 and 69 to return to their released rest positions.

Figure 20:
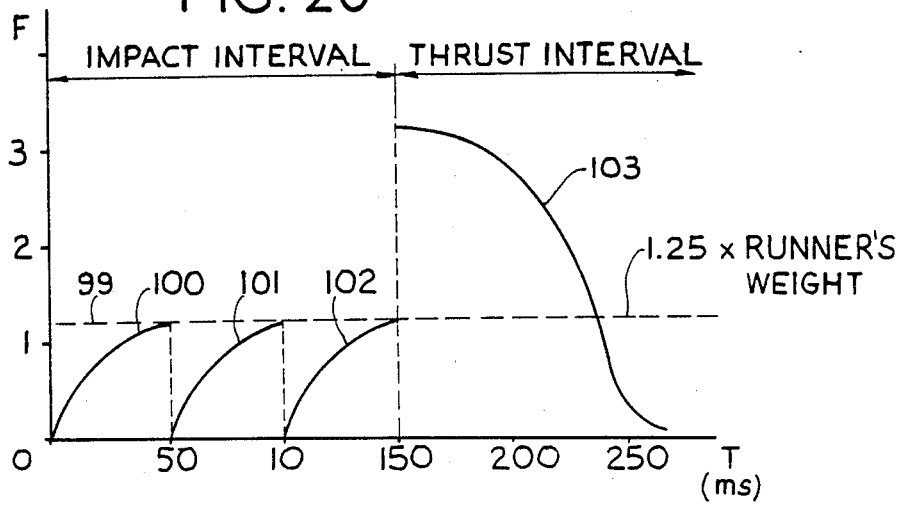
FIG. 20 is a "force versus time" curve for the fourth embodiment of this invention.

The chart of FIG. 20 illustrates the force-vs-time curve for the sequential spring embodiment of FIGS. 18 and 19. As shown in this chart, the force on the runner's body during the impact interval follows a "saw-tooth like" pattern, with the rise 100 in the first saw-tooth corresponding to the movement of storage force plate 70 from positions 73 to 74 and the accompanying compression of storage spring 67. At the moment force plate 70 reaches position 74 (corresponding to the arrival of roller bearing 87 at flat portion 96 of tab 81), the force drops to zero. It begins an essentially identical second rise 101 corresponding to the movement of storage force plate 71 from position 73 to 74, followed by another drop to zero as force plate 71 reaches position 74. This is followed by yet another sawtooth force curve with rise 102 corresponding to the movement of storage force plate 72 from positions 73 to 74. Portion 103 of the force-vs-time curve corresponds to the downward movement of thrust force plate 36 following its release by ratchet mechanism 44.

Alternatively, a separate Sylphon bellows mechanism, such as shown in FIG. 13, is used to drive each of storage plates 70, 71 and 72. In this embodiment each bellows is connected by a separate tube with a bellows to rear bellows 58. Upon impact only the valve to the first bellows is open. The compression of rear bellows 57 causes the first Sylphon bellows to expand and storage force plate 70 to move from position 73 to 74. A conventional lever system then closes the first valve and opens the second valve, at which time the second Sylphon bellows expands and storage force plate 71 moves downward. This process continues until each of the Sylphon bellows has responded, each of the storage force plates has moved downward to position 74, and each of the storage springs is fully compressed. The force-vs-time curve for this embodiment is essentially the same as the curve of FIG. 19.

Another alternative embodiment of the storage thrust means for limiting impact force is shown in FIG. 21. The objective of this embodiment is to limit the impact force to a constant curve, $F_o$, as shown in the force-vs-time curve of FIG. 22, which does not return to zero in the sawtooth manner of the previous embodiment shown in FIG. 20. This effect is achieved using a pair of bent levers 200 and 201 arranged longitudinally along drive shaft 11. Bent lever 200 pivots at its center around fixably mounted axle 202 and bent lever 201 pivots around fixably mounted axle 203. Roller bearing 204 is rotatably mounted on the upper arm of bent lever 200 and roller bearing 205 is rotatably mounted on the upper arm of bent lever 201. Roller bearings 206 and 207 are rotatably mounted to the bottom arms of bent levers 200 and 201, respectively, and ride along the top surface of storage force plates 208 and 209, respectively.

In the rest position, roller bearings 204 and 205 are positioned in contact with the lower surface of drive shaft 11. A tab 210 is mounted on drive shaft 11 and positioned rearward and immediately adjacent to roller bearing 204. Tab 210 has a leading ramp 211 at its forward edge of length $2X_o$, followed by a flat surface parallel to the bottom portion of drive shaft 11, over which surfaces roller bearing 204 rides during forward movement of the drive shaft. A second tab 212 is mounted on drive shaft 11 and positioned rearward of tab 210, and rearward and immediately adjacent to roller bearing 205. Tab 212 has a leading ramp 213 with the same incline as ramp 211 but of length $X_o$. Ramp 213 is followed by a second ramp 214, with the same incline in the opposite direction as ramp 213, so that, as viewed from its end, tab 212 forms an isosceles triangle.

As drive shaft 11 moves forward from its rest position, roller bearing 204 moves down ramp 211 causing bent lever 200 to rotate counterclockwise, depressing storage force plate 208 and compressing storage spring 215. Similarly, roller bearing 205 moves down ramp 213, causing bent lever 201 to rotate counterclockwise and depressing storage force plate 209 and compressing storage spring 216. Since storage springs 215 and 216 each exert an equal force kx while being compressed, the slope of the total force curve that they exert in opposing the forward motion of drive shaft 11 is 2kx, as shown in FIG. 22.

After roller bearing 205 has travelled a distance $X_o$, it begins moving up ramp 214, while bearing 204 continues moving down ramp 211. This causes bent lever 201 to push drive shaft 11 forward, rather than oppose such movement. Thus, the force of storage spring 216 opposes the force of storage spring 215. The sum of these two forces, indicated by the slopes +k and −k in FIG. 22, results in a constant force $F_o$ acting to oppose the forward movement of drive shaft 11.

The important point here is that optimal compliance can be achieved, which is tantamount to the curve $F(x)=F_o$, where $F_o$ is a constant, with such pairs of spring systems. There are two ways to achieve any desired shape of the F(x) curve. One is to vary the shape of ramps 211, 213 and 214 located along one or more drive shafts 11; the other is to use more than one pair of such spring systems. The latter course will be necessary when the range of motion of the storage force plate is limited, e.g., by the elastic limit of the storage springs. The fact that any desired shape can be achieved means that optimized performance of a runner can be achieved.

Another important point is that storage springs 67, 68 and 69 in FIGS. 17–18 and storage springs 213 and 214 in FIGS. 20–21 cannot be acted upon by or act upon the drive shaft when the slope of the inclined ramps is zero, i.e., parallel to the drive shaft. When this slope is zero the force on a single spring drops to zero. Furthermore, if greater forces are required, they can be achieved by conventional clutches which cause additional springs or spring-pairs to be engaged. This can be done in a fixed manner (to achieve a fixed force curve), or in a variable manner with a conventional lever system which engages and disengages additional spring systems in proportion to the impact force.

To give more rationale to the embodiments of FIGS. 16–21, one ideally would like to have optimal compliance (give of the surface), optimal resilience (give back of the surface), and a minimum of foot-contact time. Unfortunately, these goals conflict, and the optimal trade-off must be found. The first problem is that optimal compliance (a lower curve) takes more time to absorb vertical momentum, prolonging the impact interval. This is a problem for two reasons: (1) it results in slower running, and (2) the muscles have to work against the ground longer, using more energy.

In the case of the tuned track mentioned in the foregoing article by McMahon, the shape of the curve in the impact interval is approximately the mirror reflection of that in the thrust interval. Thus, the thrust interval must be the same as the impact interval. The embodiments of FIGS. 16–21 improve upon this because the maximum force during the thrust interval can be considerably more than that during the impact interval. Another way to see this is to note that each interval is proportional to the inverse square root of the spring constant. During impact, the effective spring constant (the sum of the separate spring constants) is considerably less than it is when all the springs release together during thrust. The result is that the penalty of greater foot-contact time, or equivalently, muscle-work time, need be paid only during the impact interval. Thus, these embodiments are improvements over a tuned track.

In the sequential spring embodiment of FIGS. 16–21 it may be necessary to restrict the value of the effective spring constant during thrust (equal to the sum of the sequenced spring constants) to a value that is not injurious to the foot and leg, especially the shins. In this case, the spring travel has to be correspondingly longer.

Figure 23:
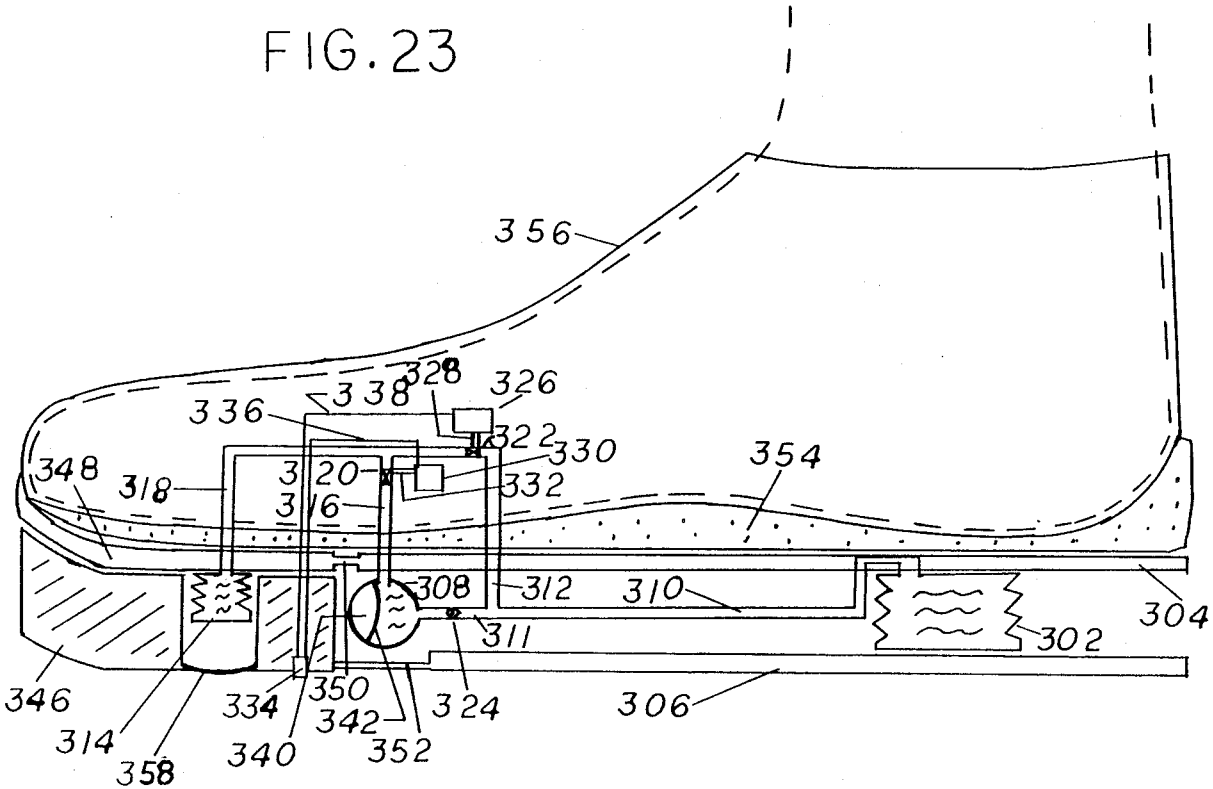
FIG. 23 is a side view showing the hydraulic energy transfer mechanism of the fifth embodiment of this invention.

FIG. 23 depicts the essential components of the fifth, and preferred embodiment of the energy-efficient running shoe. In this embodiment the energy storage means is a separate and distinct mechanism from the means which release energy upon thrust off of the running surface. This embodiment has several advantages over the earlier embodiments, i.e., it employs (1) a simple light linkage mechanism for heel stability, (2) a light intermediate accumulator for convenient energy storage, and (3) a timing system for energy fluid transfer.

Rear bellows 302 is sandwiched between upper rear plate 304 and lower rear plate 306 and is connected to energy accumulator 308 via the path consisting of tubes 310 and 311. Rear bellows 302 is also connected to front bellows 314 via the path consisting of tubes 310, 312, and 318. Energy accumulator 308 is connected to front bellows 314 via the path consisting of tubes 316 and 318. Tube 316 contains forward-flow valve 320, tube 312 contains backflow valve 322, and tube 311 contains check valve 324 which permits flow only into energy accumulator 308 from rear bellows 302. Backflow timing mechanism 326 opens and closes backflow valve 322 at prescribed times via backflow actuator 328. Likewise, forward-flow timing mechanism 330 opens and closes forward-flow valve 320 via forward-flow actuator 332. Foot-strike trigger 334 triggers forward-flow timing mechanism 330 via forward-flow signal line 336 and backflow timing mechanism 326 via backflow signal line 338.

Energy accumulator 308 contains pressurized gas 340 which is separated from the hydraulic fluid in accumulator 308 by diaphragm 342. Front bellows 314 is housed inside resilient front sole 346 in such a manner that the sides of these two components do not touch and in such a manner that the bottoms of these two components push against the running surface together during toe thrust. Front plate 348 is flexibly connected to upper rear plate 304 via upper plate connector 350 in such a manner that the runner's foot is free to bend at the toe.

In like manner, lower rear plate 306 is flexibly connected to resilient front sole 346 via lower plate connector 352. Foam insert 354 ensures that the runner's foot is comfortably supported by upper rear plate 304 and by front plate 348. Fabric top 356 constrains the runner's foot to the entire sole assembly in a conventional manner. Front cover 358 protects front bellows 314 from wear and dirt.

The following is the sequence of actions by which the fifth embodiment captures heel impact energy and returns it in toe thrust. Upon heel impact rear bellows 302 is compressed between upper rear plate 304 and lower rear plate 306. Hydraulic fluid is thereby forced into energy accumulator 308 via tubes 310 and 311. Check valve 324 prevents this fluid from flowing back through tubes 310 and 311 to rear bellows 302. Rear bellows 302 remains compressed after this fluid is expelled due to the vacuum created in tubes 310 and 311. During this time, backflow valve 322, and forward-flow valve 320 are closed, thereby preventing hydraulic fluid from flowing into front bellows 314. Check valve 324 prevents hydraulic fluid from flowing back from energy accumulator 308 into rear bellows 302.

When the runner begins toe thrust, forward-flow timing mechanism 330 is triggered by foot-strike trigger 334 via forward-flow signal line 336. This triggering causes forward-flow valve 320 to open. This, in turn, allows pressurized gas 340 to expand, forcing hydraulic fluid into front bellows 314, which expands to push against the running surface giving a spring board effect to lift the runner back into the air. The stiffness and thickness of resilient front sole 346 are chosen so that it compresses under front sole impact until its bottom surface is approximately even with the bottom surface of front bellows 314. Then, both resilient front sole 346 and front bellows 314 push together in toe thrust.

Forward-flow timing mechanism 330 causes forward-flow actuator 332 to close forward-flow valve 320 when the runner's foot has just left the running surface. This prevents pressurized fluid from leaving energy accumulator 308 during the recovery period when the runner's foot is in the air and prevents fluid in front bellows 314 from returning to accumulator 308 after toe strike. When the runner's foot is in the air backflow timing mechanism 326 causes back-flow actuator 328 to open backflow valve 322. The negative pressure created by the vacuum in rear bellows 302 and line 310 then draws the fluid into rear bellows 302 through tubes 318, 312 and 310. Rear bellows 302 also acts as a weak spring, which aids in drawing the fluid back into it from front bellows 314. After the fluid has been drawn into rear bellows 302, backflow timing mechanism 326 causes backflow actuator 328 to close backflow valve 312. The shoe is then ready for the next heel strike. Foot strike trigger 334 initiates the timing for the opening and closing of forward-flow timing mechanism 328 and backflow timing mechanism 326.

One advantage of this design is that the hydraulic fluid can be moved back to the heel without having to perform work against high pressure in the closed hydraulic fluid system. This minimizes the portion of heel energy used to compress rear bellows 302 during impact. Since this portion of heel impact energy is not transmitted forward, this minimization, in turn, maximizes the energy efficiency of the invention. It should be understood that foot-strike trigger 334 can be in another part of the shoe, with the appropriate adjustment to the timing in forward-flow timing mechanism 330 and backflow timing mechanism 326.

An essential feature of the fifth embodiment is that the impact energy is stored under compression in accumulator 308 so that it can then expand front bellows 314 during toe thrust. This is accomplished with a minimum of parts by virtue of the timing system and the manner in which front bellows 314 is housed in resilient front sole 346 without any need for guide systems to provide for front-sole lateral stability. That is, resilient front sole 346 provides for front-sole lateral stability.

It should be understood that energy accumulator 308 can be modified in a variety of ways. For example, the use of a reservoir connected to the gas side of energy accumulator 308 changes the "force vs distance" curve for compression of the rear sole. That is, instead of the heel impact force being proportional to the inverse gas volume, it is proportional to the inverse of the sum of the gas volume plus a constant. This reduces the maximum force on the leg, but at the price of requiring a higher initial pressure in the hydraulic system. As another example, the shape of energy accumulator 308 can be designed to modify the above-mentioned force curve. Another alternative is to use an energy accumulator with a hydraulic piston to compress a mechanical spring. Or, one could store the energy by expanding a stiff elastomer bladder. Finally, a combination of one or more of these embodiments could be used.

The shape of energy accumulator 308 depends on its location and style considerations. For the location shown in FIG. 1, a cylindrical shape works best.with the vertical axis of the cylinder oriented laterally. This allows a relatively large volume to be accommodated in a relatively thin sole. With molded fabrication the shape could be one in which the ends are rounded. Or for minimization of the sole thickness, the shape could be that of an oblate spheroid. The advantage of the location shown in FIG. 1 is that the hydraulic tube length is minimized and energy accumulator 308 is hidden. Alternatively, the location can be on the outside of the sole, or on the top or back of the shoe. Pressure points under the toe area are eliminated by making front plate 348 sufficiently stiff to distribute the pressure exerted by front bellows 314 over the entire toe area. Front plate 348 is stiffened, for example, using composite material or laminated material.

Front bellows 314 in the fifth embodiment may have, for example, an area of 25 $cm^2$. Assuming it has a vertical travel of 2 cm, the working volume of front bellows 314 is 0.05 liters. This corresponds to a weight of approximately 20 gm or 0.7 oz which is acceptable for current light-weight running shoes. Assuming this volume, a compression ratio of 4:1 in energy accumulator 308, and 100 joules for the impact energy (this corresponds to a 100 km person bounding 10 cm into the air while running), the initial pressure in energy accumulator 308 is 15 atmospheres, and the final pressure 60 atmospheres.

In the preferred embodiment for front bellows 314 and rear bellows 302, lightness is achieved using a Sylphon bellows with walls made of a flexible synthetic fabric reinforced with metal or plastic hoops. This type of bellows collapses almost completely flat, allowing the front sole to be optimally thin. Alternatively, these bellows could be replaced by bladders, a very weak conical disk spring, a conical disk bellows, or pistons. Also, the area of these embodiments need not be restricted to a circular shape. The goal is lightness and the capability of compressing the component completely flat. The flatness capability contributes to lightness because it minimizes the amount of hydraulic fluid. The other requirement of this component is that its surface not stretch when compressed, since stretching would lower the energy efficiency.

If a bladder is used instead of rear bellows 302, a spring or a expanding device must be used inside to expand the bladder during recovery. This could be any device which returns to its original shape when not compressed, and which is just barely strong enough to accomplish this shape return. For example, interlocking hoops could be used, provided that they are not compressed beyond their elastic limit when the bladder is fully compressed.

Tubes 310, 311, 312, 316, and 318 have the smallest diameter possible without causing significant flow resistance and reducing energy efficiency. Valves 311, 320 and 322 are of a conventional design and are mechanically actuated, again using conventional mechanisms consisting of cables and levers. Alternatively, servovalves can be used which are electrically actuated. Forward-flow timing mechanism 330 and back flow timing mechanism 326 are conventional and similar to those used to control camera shutter speeds. Thus, the time delays can be adjusted for different runners and different running speeds. Alternatively, electronic timers can be used which are also adjustable. Finally, footstrike trigger 334 has a conventional design in which a pin protruding below front sole 346 causes a brake cable (first and second signal lines 338 and 336) to trigger first and second timing mechanisms 326 and 330 upon heel impact. Alternatively, the foot trigger could be an electronic pressure detector, and the signal lines 338 and 336 could be electrical.

Upper plate connector 350 and lower plate connector 352 allow toe flexion. Alternatively, these connectors could be eliminated by making upper rear plate 304 and front plate 348 a single thin member with adequate flexion. Similarly, resilient front sole 346 and lower rear plate 306 could be made a single member with adequate flexion.

The fact that heel and mid-sole portions of the running shoe sole are hollow in places saves weight but creates heel instability. In particular, rear plate 304 and lower rear plate 306 are free to move with respect to each other in a lateral shear mode and a longitudinal torsional mode. The stiffness of these two plates, however, prevents longitudinal shearing. Fabricating rear bellows 302 with a sufficiently large diameter and a sufficiently large bellows wall width, w (see FIG. 24) improves heel stability.

Further improvement requires an auxiliary heel stabilizer. FIG. 24 shows the first embodiment of this mechanism. Rear bellows 302 is contained in stabilizer bellows 360, which does not contain hydraulic fluid and which has a large diameter and wall width "w" for resistance to shear and torsional motion. This permits the stabilizing benefit of such a stabilizing bellows without paying the weight penalty of filling the entire large stabilizing bellows with hydraulic fluid. The tops and bottoms of rear bellows 302 and stabilizer bellows 360 are fixably attached to upper rear plate 304 and lower plate 306, respectively. This embodiment of an auxiliary heel stabilizer can be used in the mid-sole as well as the heel-sole.

An alternative embodiment of an auxiliary heel stabilizer is shown in rear view (FIG. 25), top view (FIG. 26), and side view (FIG.27). Back frame 362 is rigidly attached to lower rear plate 306 and reinforced by x-brace 364. Stabilizer cables 366, on either side of the heel, connect upper plate 304 to back frame 362, via roller axle 369, mounted in stabilizer roller 368. Stabilizer cables 366 have minimum elasticity, thereby constraining upper rear plate 304 from moving in a lateral shear or longitudinal torsional mode with respect to lower rear plate 306. Stabilizer roller 368 prevents binding which would reduce the energy efficiency of the invention. The design of this auxiliary heel stabilizer permits optimal lightness. It should be understood that its shape can be modified from a rectangular shape to a curved shape to conform to the runner's heel.

Figure 28:
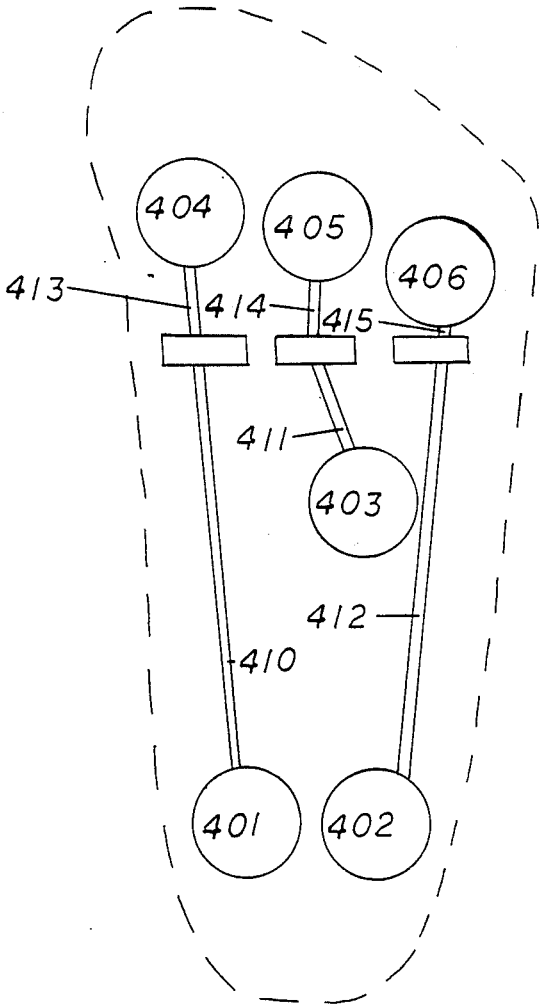
FIG. 28 is a top view of a sixth embodiment of the invention showing possible locations of multiple hydraulic bellows and multiple energy accumulators of the type used in the fifth embodiment.

FIG. 28 shows an alternative arrangement of the hydraulic energy transfer mechanism of the fifth embodiment of the instant invention. This arrangement distributes the runner's impact forces over the running shoe sole, resulting in reduced weight for upper rear plate 4 and lower rear plate 6 without sacrificing foot comfort. It also allows individualized adjustments for effects like pronation. The penalty is the added complication of more components and a slight increase in bellows weight.

In operation, multiple rear bellows 401 and 403, and mid-sole bellows 402 are compressed in heel and mid-sole strike, thereby forcing hydraulic fluid into multiple energy-accumulators, 421, 422, and 423, respectively. In toe thrust, the fluid is forced into multiple front bellows, 404, 405, and 406, respectively, for a spring board effect. The locations of the various bellows and the gas pressures in the various multiple energy-accumulators can be varied for individual orthopedic adjustment.

Alternatively, a plurality of rear bellows could feed a single energy accumulator, which could then feed a plurality of front bellows. This would eliminate some of the multiple energy-accumulators.

In addition to the foregoing embodiments, other sources of energy can be used to supplement the energy of heel impact. In such an embodiment, the work performed by any voluntary muscle group in the body can be used to provide such additional energy. For example, the runner can squeeze Sylphon bellows or pistons with his hands, arms or legs and the resulting force can be transmitted hydraulically by a tube to the storage/-thrust mechanism. Alternatively, the runner can pull and push conventional piston or lever systems with the arms and legs, or the energy can be electrically stored and then transmitted to the storage mechanism by conventional electro-mechanical transducers. This embodiment allows a more complete exercise because more muscles are involved, and this allows enhanced performance over what can be achieved when only the running muscles of the legs are used.

In yet another embodiment the invention would be separate from the runner's shoe. For example, it can be contained in a separate sole that is strapped onto the runner's shoe.

Obviously, numerous additional modifications and variations of the present invention are possible in light of the above teachings. It is therefore to be understood that within the scope of the appended claims the invention may be practiced otherwise than as specifically described herein.

What is claimed as new and desired to be secured by Letters Patent of the U.S. is:

1. An energy-efficient shoe wherein the sole of said shoe comprises:

intermediate energy storage means for storing energy of heel impact upon a running surface;

transmission means in the heel of said sole for transmitting said energy to said intermediate energy storage means; and thrust means in the front of said sole and coupled to said intermediate energy storage means for releasing said energy during thrust off of said running surface, whereby the center of mass of the wearer of said shoe is impelled upward from said running surface.

2. The energy-efficient shoe of claim 1, wherein said transmission means comprises:

a rear force plate for receiving the force of said heel impact;

force re-direction means for changing the direction of said heel impact force from substantially perpendicular to said rear force plate to substantially parallel with said rear force plate; and force transmission means for transmitting said direction-changed heel impact force from the rear of said sole to the front of said sole.

3. The energy-efficient shoe of claim 2, further comprising a housing to which said rear force plate is movably coupled and which prevents said rear force plate from tilting relative to the plane of said sole.

4. The energy-efficient shoe of claim 2, wherein said force re-direction means comprises:

a pair of bent levers;

two pairs of hinged links; and an axle embedded in said sole, wherein said bent levers are rotatably connected at the opposite ends of said axle and the end of each arm of each of said bent levers is rotatably connected to one of said hinged links.

5. The energy-efficient shoe of claim 2, wherein said force transmission means comprises a pair of drive shafts and a housing for said drive shafts and wherein said drive shafts are coupled at one end thereof to said first force re-direction means and coupled at the opposite end thereof to said second force re-direction means.

6. The energy-efficient shoe of claim 2, wherein said first force re-direction means comprises a pair of rack and pinion mechanisms, each of which comprises:

a first rack aligned perpendicular to the plane of said rear force plate and coupled at one end to said rear force plate;

a second rack aligned parallel to the plane of said rear force plate and coupled at one end to said force transmission means; and a pinion rotatably coupled to said first rack and the opposite end of said second rack.

7. The energy-efficient shoe of claim 1, wherein said thrust means comprises:

a storage force plate;

a thrust force plate;

energy release means which allows said thrust force plate to push against said running surface during thrust; and recovery means which allows said storage force plate and said thrust force plate to return to their pre-impact positions after thrust of said shoe.

8. The energy-efficient shoe of claim 7, wherein said intermediate energy storage means comprises:

means coupled to said transmission means for moving said storage force plate toward said thrust force plate in response to the energy received from said transmission means;

energy storage means connected between said storage force plate and said thrust force plate; and ratchet means which allow said storage force plate and said thrust force plate to move only toward each other, thereby increasing the energy stored in said energy storage means.

9. The energy-efficient shoe of claim 8, wherein said energy storage means comprises a helical spring.

10. The energy-efficient shoe of claim 8, wherein said energy storage means comprises an elastomer.

11. The energy-efficient shoe of claim 8, wherein said energy storage means comprises a resilient plastic material.

12. The energy-efficient shoe of claim 1 wherein said thrust means comprises:

a plurality of storage force plates;

a thrust force plate;

energy release means for allowing said thrust force plate to push against said running surface during thrust; and a plurality of recovery means, each of which is coupled to a different one of said storage force plates and allows said storage force plate to return to its rest position after thrust.

13. The energy-efficient shoe of claim 12, wherein said intermediate energy storage means comprises:

a plurality of springs, each of which is connected at one end to a different one of said storage force plates and at the other end to said thrust force plate; and means for moving said storage force plates toward said thrust force plate in a timed sequence whereby only one storage force plate moves at a time and each succeeding storage force plate begins said movement after the preceding storage force plate reaches its closest distance to said thrust force plate.

14. The energy-efficient shoe of claim 13, wherein said moving means comprises a plurality of bent lever driving means each of which comprises:

a bent lever;

a first roller bearing rotatably mounted at the end of one arm of said bent lever and in contact with the top surface of said storage force plate; and a second roller bearing rotatably mounted at the end of the other arm of said bent lever and in contact with said transmission means, whereby said bent lever rotates in response to the energy transmitted by said transmission means and moves a different one of said storage force plates towards said thrust force plate.

15. The energy-efficient shoe of claim 13, wherein said moving means comprises:

a plurality of bellows, each of which is connected at one end to a different one of said storage force plates;

a control valve having a single input port, a plurality of output ports and means for routing hydraulic fluid from said input port to each of said output ports in a timed sequence; and a plurality of output tubes, each of which is coupled at one end to a different one of said output ports and at the other end to a different one of said bellows, whereby each of said bellows is hydraulically activated in said timed sequence.

16. The energy-efficient shoe of claim 1, wherein said thrust means comprises:

a first storage force plate;

a second storage force plate;

a thrust force plate;

energy release means for allowing said thrust force plate to push against said running surface during thrust; and recovery means for allowing said first storage force plate and said second storage force plate to return to their rest positions after thrust of said shoe.

17. The energy-efficient shoe of claim 16, wherein said intermediate energy storage means comprises:

a first storage spring connected at one end to said first storage force plate and at the other end to said thrust force plate;

a second storage spring connected at one end to said second storage force plate and at the other end to said thrust force plate; and means for moving said first storage force plate and said second storage force plate to achieve for a first specified period of time a linearly increasing force acting against said thrust force plate and to achieve for a second specified period of time a constant force acting against said thrust force plate.

18. The energy-efficient shoe of claim 1, wherein said transmission means comprises:

a rear force plate for receiving said heel impact force;

a first housing mounted over said rear force plate;

a second housing mounted at the front of said shoe sole;

a bellows connected at one end to said rear force plate and at the other end to said housing; and a tube connected at one end to said bellows and at the other end to said storage/thrust means, whereby said heel impact force moves said rear force plate upward, causing compression of said bellows and hydraulic transmission of said heel impact energy to said storage/thrust means.

19. The energy-efficient shoe of claim 18, wherein said bellows contains a plurality of hollow spheres, each of which has a diameter at least three times the diameter of said tube.

20. The energy-efficient shoe of claim 1, wherein said transmission means comprises:

a rear force plate for receiving said heel impact force;

a housing mounted over said rear force plate;

a piston connected at one end to said rear force plate and at the other end to said housing; and a tube connecting the chamber of said first piston to said storage/thrust means, whereby said heel impact force moves said rear force plate upwards causing compression of said first piston and operation of said storage/thrust means.

21. The energy-efficient shoe of claim 1, wherein said transmission means comprises:

a rear force plate for receiving said heel impact force;

a housing mounted over said rear force plate;

a drive shaft aligned parallel to said sole;

a first bellows having its axis aligned perpendicular to the sole of said shoe and connected at one end to said rear force plate and at the other end to said housing;

a second bellows having its axis aligned parallel to the sole of said shoe and connected at one end to said housing and at the other end to said drive shaft; and a tube connected between said first bellows and said second bellows, whereby said heel impact force compresses said first bellows, expands said second bellows and moves said drive shaft forward.

22. The energy-efficient shoe of claim 1, wherein said energy is transmitted by hydraulic fluid from said transmission means to said intermediate energy storage means and from said intermediate energy storage means to said thrust means.

23. The energy-efficient shoe of claim 22, wherein said transmission means comprises:

an energy accumulator for storing hydraulically delivered energy;

a first energy transfer means for transmitting hydraulic fluid from said transmission means to said energy accumulator;

a second energy transfer means for transmitting said hydraulic fluid from said energy accumulator to said thrust means; and a third energy transfer means for transmitting said hydraulic fluid from said thrust means to said transmission means.

24. The energy-efficient shoe of claim 23, wherein said first energy transfer means comprises:

a tube for transmitting hydraulic fluid from said transmission means to said energy accumulator; and a valve connected to said tube for permitting said hydraulic fluid to flow from said transmission means to said energy accumulator and for preventing said hydraulic fluid from flowing from said energy accumulator to said transmission means.

25. The energy-efficient shoe of claim 23, wherein said energy accumulator comprises:

a first compartment for storing said hydraulic fluid; and a second compartment isolated from said first compartment for storing a compressible gas.

26. The energy-efficient shoe of claim 25, wherein said energy accumulator comprises:

a housing;

a compressible medium contained in said housing; and actuation means for hydraulically compressing said compressible medium.

27. The energy-efficient shoe of claim 25, wherein said compressible medium comprises a gas.

28. The energy-efficient shoe of claim 26, wherein said compressible medium comprises a mechanical spring.

29. The energy-efficient shoe of claim 26, wherein said compressible medium comprises an elastomer.

30. The energy-efficient shoe of claim 23, wherein said second fluid transfer means comprises:

a tube connected between said energy accumulator and said thrust means;

a valve connected to said tube for permitting hydraulic fluid to flow from said energy accumulator to said thrust means through said tube; and control means for opening said valve during impact of the toe portion of said sole on said running surface and for closing said valve after said hydraulic fluid is transmitted from said energy accumulator to said thrust means.

31. The energy-efficient shoe of claim 23, wherein said third fluid transfer means comprises:

a tube connected between said thrust means and said transmission means;

a valve connected to said tube for permitting hydraulic fluid to flow from said thrust to said transmission means; and control means for opening said valve immediately following thrust off of said running surface by said shoe and for closing said valve at other times, whereby said hydraulic fluid is transmitted from said thrust means to said transmission means when said valve is opened.

32. The energy-efficient shoe of claim 22, wherein said means comprises;

a front plate attached to the front portion of said sole; and an hydraulic reservoir fixedly attached at one end to said front plate and located in a cavity in said front portion of said sole.

33. The energy-efficient shoe of claim 32, wherein said impeller means further comprises a resilient front portion of said sole for storing toe impact energy.

34. The energy-efficient running shoe of claim 22, wherein said transmission means comprises:

a rear hydraulic reservoir in the heel portion of said sole containing hydraulic fluid prior to impact of said heel upon said running surface;

an upper rear plate in the top of said sole fixedly attached to one end of said rear hydraulic reservoir; and a lower rear plate in the bottom of said sole, fixedly attached to the opposite end of said rear hydraulic reservoir, wherein during impact of said heel upon said running surface said upper rear plate and said lower rear plate compress said rear hydraulic reservoir, thereby transmitting said hydraulic fluid from said rear hydraulic reservoir to said intermediate energy storage means.

35. The energy-efficient shoe of claim 34, wherein said rear hydraulic reservoir comprises a bellows.

36. The energy-efficient shoe of claim 34, wherein said rear hydraulic reservoir comprises a conical disk spring.

37. The energy-efficient shoe of claim 34, wherein said hydraulic reservoir comprises a bladder.

38. The energy-efficient shoe of claim 34, wherein said rear hydraulic reservoir comprises a piston.

39. The energy-efficient shoe of claim 34, further comprising heel stabilizer means for preventing shear and torsional motion of said heel.

40. The energy-efficient shoe of claim 39, wherein said heel stabilizer means comprises a bellows surrounding said rear hydraulic reservoir.

41. The energy-efficient shoe of claim 39, wherein said heel stabilizer means comprises:

a back frame rigidly attached to the bottom of said lower rear plate, oriented vertically with height approximately equal to the thickness of said sole and width extending across the back of said sole;

a cross frame for strengthening said back frame;

stabilizer cables for providing a sliding connection between said back frame and said upper rear plate; and stabilizer rollers for allowing said sliding connection to have low friction, wherein said upper rear plate is constrained to move up and down with respect to said lower rear plate during foot strike, without significant tilting or shearing.

42. An energy-efficient shoe wherein the sole of said shoe comprises:

a plurality of intermediate energy storage means for storing energy of heel impact upon a running surface;

a plurality of transmission means in the heel of said sole, each of which transmits energy of heel impact upon a running surface to a corresponding one of said intermediate energy storage means; and a plurality of thrust means positioned in the front of said sole, each of which is coupled to a corresponding one of said intermediate energy storage means and releases during thrust off of said running surface said energy accumulated by said one of said corresponding intermediate energy storage means, whereby the center of mass of the wearer of said shoe is impelled upward from said running surface.

43. The energy-efficient shoe of claim 42, wherein the sole of said shoe further comprises transmission means located in the mid-sole portion thereof for transmitting energy obtained from impact of said mid-sole portion on said running surface to locations forward of said mid-sole portion.

* * * * *